United States Patent [19]

Beck et al.

[11] 4,383,202

[45] May 10, 1983

[54] FLASHING FLORESCENT LAMPS

[75] Inventors: Charles E. Beck, Chesterland; Richard T. Kadlec, Cleveland, both of Ohio

[73] Assignee: General Electric Company, Schenectady, N.Y.

[21] Appl. No.: 219,002

[22] Filed: Dec. 22, 1980

[51] Int. Cl.[3] ..... H05B 41/30

[52] U.S. Cl. ..... 315/200 A; 315/101; 315/209 R

[58] Field of Search ..... 315/100, 101, 105, 200 A, 315/208, 209 R, 240, 241 S, 291, 362; 340/331; 40/442

[56] References Cited

U.S. PATENT DOCUMENTS

| | | | |
|---|---|---|---|
| 2,858,478 | 10/1958 | Kershaw | 315/98 |
| 3,611,024 | 10/1971 | Nakatsu | 315/205 X |
| 3,710,185 | 1/1973 | Switsen | 315/200 A X |
| 3,719,857 | 3/1973 | Sharp | 315/DIG. 4 |
| 3,731,142 | 5/1973 | Spira et al. | 315/94 |
| 3,753,040 | 8/1973 | Quenelle | 315/241 S |

FOREIGN PATENT DOCUMENTS

| | | | |
|---|---|---|---|
| 1093865 | 12/1967 | United Kingdom | 315/200 A |

*Primary Examiner*—Eugene R. LaRoche

*Attorney, Agent, or Firm*—Norman C. Fulmer; Philip L. Schlamp; Fred Jacob

[57] ABSTRACT

Fluorescent lamps are flashed by modulating the lamp operating current during a given half-cycle. The other half-cycle operation is unmodulated, thereby resulting in flashing from full lamp brilliance to substantially one-half lamp brilliance. In one embodiment, the modulating circuitry is placed in the line cord providing power to the lamp. The circuitry includes a gated diode and a resistor placed in parallel with each other. A full wave line cord embodiment employs a diode bridge. In another embodiment, the modulating circuitry is placed across the terminals of a conventional fluorescent lamp starter so that current is bypassed around the starter. With this embodiment of the invention, the discharge on half of the cycle is extinguished, but current flows through the lamp electrodes, thereby keeping them hot enough to emit electrons and prevent life-damaging high cathode fall.

17 Claims, 8 Drawing Figures

FLASHING FLORESCENT LAMPS

CROSS-REFERENCE TO RELATED APPLICATION

LAMP MODULATION CIRCUITRY, U.S. application Ser. no. 219,003, filed concurrently by T. E. Anderson and assigned to the assignee of the present invention, here the "Audio Modulated Lamp Patent," the disclosure of which is incorporated herein by reference.

BACKGROUND OF THE INVENTION

1. Field of the Invention

The invention relates to techniques for flashing fluorescent lamps and, more particularly, to circuitry which either may be placed in the line cord providing power to a fluorescent lamp or which may be shorted across, or included as part of, a starter used with a fluorescent lamp.

2. Description of the Prior Art

Fluorescent lamps have been used for a number of years to provide economical, efficient lighting. Although fluorescent lamps have desirable lighting qualities, the nature of their operation has limited their uses to more or less steady state operation. Either they are operated continuously at full capacity or they are not operated at all. Under certain conditions it would be desirable to flash fluorescent lamps, particularly ultraviolet fluorescent lamps, to the beat of music or other audio signals. It also may be desirable to flash fluorescent lamps, particularly ultraviolet fluorescent lamps, at a predetermined frequency on the order of two or three flashes per second independently of external signals. Unfortunately, prior techniques for flashing fluorescent lamps have not been entirely satisfactory.

Most prior techniques for flashing fluorescent lamps depend upon maintaining electrode heat relatively high during the flashing cycle. In one known technique, separate filament transformers are connected across the electrodes and current to one of the filament transformers is periodically interrupted. This technique functions adequately, but expense of the assembly is higher than desired. Another technique is to periodically change the current flowing through a resistor ballast by use of an incandescent flasher lamp. Unfortunately, this technique is unacceptable because the life of a typical incandescent flasher lamp is only about 20–500 hours, compared with a typical fluorescent lamp life of about 6000 hours.

One technique which has been experimented with in the flashing of fluorescent lamps is to bypass, or short, current across the terminals of the starter. This technique has the advantage of extinguishing the lamp discharge, but preheat current flows through the electrodes keeping them hot enough to emit electrons and prevent life-damaging high cathode fall. At least one prior technique for shorting the lamp terminals requires the removal of the starter and replacement by separate flasher circuitry. Either the lamp operates conventionally or it operates entirely in a flashing mode. This is a considerable limitation on the practical implementation of flashing circuitry for fluorescent lamps.

A desirable approach to flashing fluorescent lamps would be to place a flasher in the line cord powering the lamp, that is, "upstream" of the lamp. This technique would have the advantage of not requiring the modification of existing lamp constructions or lamp-manufacturing equipment. It would be a relatively simple matter to install the flashing circuitry in the line cord of a fluorescent lamp. Prior techniques for flashing fluorescent lamps by employing circuitry located "upstream" of the lamp have had the drawbacks of requiring separate filament transformers or short flasher life, as mentioned previously, or have employed unduly expensive components.

In view of the foregoing problems, it is an object of the invention to provide a flashing fluorescent lamp.

It is another object of the invention to provide a flashing fluorescent lamp requiring a minimum of components to carry out a flashing operation.

It is yet another object of the invention to provide an inexpensive flashing fluorescent lamp.

It is yet another object of the invention to provide a flashing fluorescent lamp in which the life of the lamp and flasher circuitry approximates that of conventional, non-flashing fluorescent lamps.

It is yet another object of the invention to provide a flashing fluorescent lamp wherein flasher circuitry bypasses current past a starter.

It is a still further object of the invention to provide a flashing fluorescent lamp wherein flashing circuitry is included as part of the line cord supplying power to the fluorescent lamp.

SUMMARY OF THE INVENTION

The foregoing disadvantages of the prior art are overcome, and the objects of the invention are carried out, in one embodiment, by bypassing, or shorting, current across the starter of a conventional fluorescent or ultraviolet lamp. The invention includes a solid state flasher connected across the terminals of the starter providing a normally non-conducting circuit which is conductive for approximately eight cycles out of each 60 hertz signal, being adjustable for flash rates of approximately one-half flash per second to approximately five flashes per second. The flasher extinguishes the lamp for only half of the full-wave cycle because a silicon controlled rectifier (SCR) is used to modulate the current. That is, half-cycle current is shorted in one direction for several cycles, and then the bypass is removed. Accordingly, the lamp flashes between full brilliance and substantially half brilliance. The flasher circuitry can be incorporated in a starter housing and substituted in its entirety for previously installed starters.

Another embodiment of the invention is installed in the line cord leading to the lamp, thereby avoiding the need to modify existing production fluorescent lamps or lamp-manufacturing equipment and simplifying installation of the flasher circuitry. This embodiment of the invention includes essentially the same flasher circuitry as in the first-mentioned embodiment, except that a bypass resistor is added in parallel to prevent deionization of the lamp. If half-wave suppression is adequate, an SCR can be placed in parallel with the resistor. If full-wave suppression is desired, a diode bridge can be installed in parallel with the resistor.

DESCRIPTION OF THE PREFERRED EMBODIMENT

Figure 1:
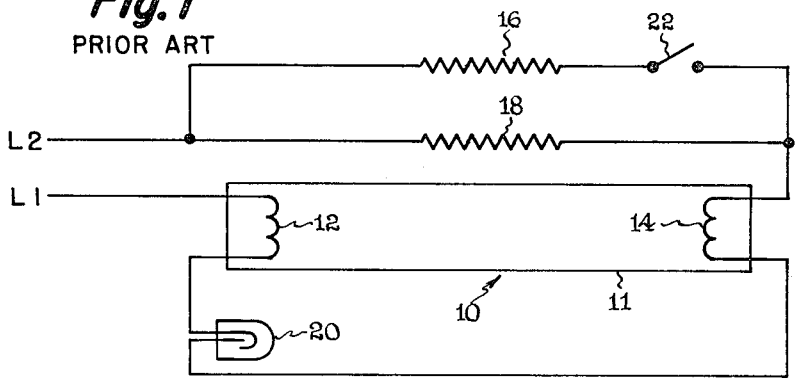
Fig. 1 PRIOR ART
FIG. 1 is a view of a typical prior art fluorescent lamp flashing circuit.

FIG. 1 is a schematic representation of a typical piror art fluorescent lamp having a flashing capability in which a fluorescent lamp 10 is powered by line cords L1, L2 conveying current from a nominal 110 volt source of alternating current having a frequency of 60 hertz. As is common in such applications, the lamp 10 includes a glass tube 11 containing mercury vapor under low pressure and carrying electrodes 12, 14 at opposite ends of the tube 11. If desired, a lamp producing ultraviolet light can be substituted for the conventional "white light" lamp 10 illustrated in the drawings. In either case, the lamp 10 includes ballast resistors 16, 18 placed in parallel with each other in the line cord L2. A starter 20 is connected across the electrodes 12, 14. In order to start the lamp 10, the starter 20 is closed and current conducted through the electrodes 12, 14 heats them to the point where electron discharge occurs. At that point, the starter 20 opens and electrons are conveyed back and forth within the tube 11. All of the foregoing construction and operation are well known in the art.

A flasher switch 22 can be placed across one leg of the resistor ballast so that, upon activating the flasher switch 22, impedance in the line L2 alternately is increased and decreased. In turn, the lamp 10 appears to flash. Unfortunately, prior commercially viable flashers illustrated schematically by the switch 22 have yielded a short life, on the order of 20–500 hours, a life unacceptable under modern conditions. A typical fluorescent lamp 10 will have a life of approximately 6,000 hours, and it is necessary that flashing circuitry used with such a lamp 10 have a similar life.

Figure 2:
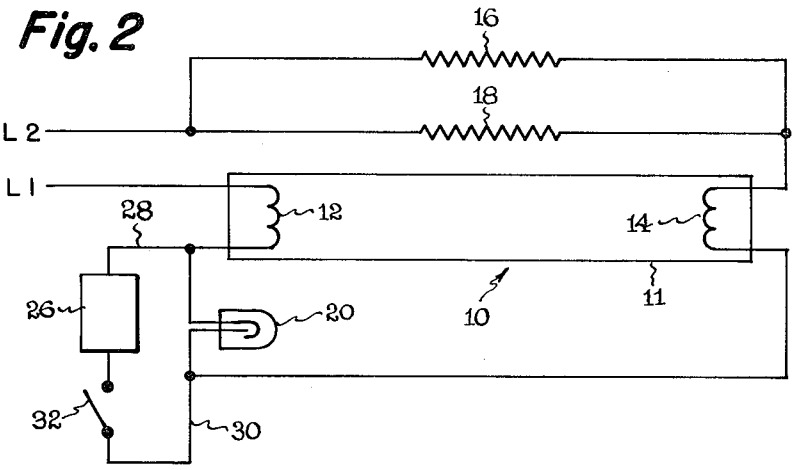
FIG. 2 is a view of one embodiment of a flashing circuit according to the invention in which the flashing circuitry is connected across terminals of a starter.

In accordance with one embodiment of the present invention as shown in FIG. 2, and using reference numerals from FIG. 1 where appropriate, a flasher 26 is connected across the starter 20 so as to bypass current across the starter 20. The flasher 26 is connected across the starter 20 by leads 28, 30. Upon activating the flasher 26 to a conducting mode, current is conducted through the flasher 26, past the starter 20, and through the electrodes 12, 14. Even though the lamp 10 is extinguished under these circumstances, the current flowing through the electrodes 12, 14 keeps them hot enough to emit electrons and thereby prevent life-damaging high cathode fall.

Figure 3:
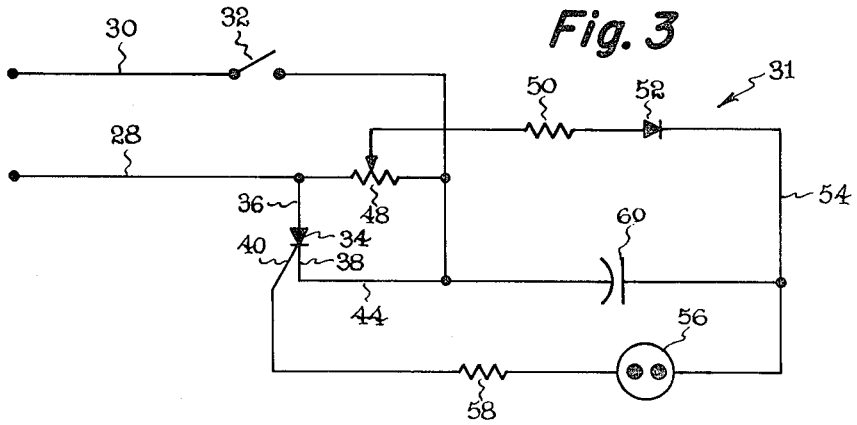
FIG. 3 is a detailed view of the flashing circuitry of the first embodiment of the invention.

Referring to FIG. 3, a first embodiment of flasher circuitry 31 according to the invention is shown. The flasher circuitry 31 may be connected across the starter 20, as illustrated in FIG. 2, or it may be incorporated within a starter housing for replacement of existing installed starters. If desired, a switch 32 can be provided for the flasher circuitry 31 so that the flasher 26 can be disabled, if desired. Thus, the lamp 10 can be operated either in a flashing mode or a non-flashing mode. If the flasher circuitry 31 is provided in the housing of a starter, the switch 32 can project outwardly of the housing for activation by a user of the lamp 10.

The flasher 26 includes a silicon controlled rectifier (SCR) 34 having an anode terminal 36, a cathode terminal 38, and a gate terminal 40. The terminal 36 is connected to the lead 28 which is connected on one side of the starter 20. The terminal 38 is connected to a line 44. The lead 30 is connected to the line 44 and in turn is connected to the other side of the starter 20 from the lead 28. Accordingly, the SCR 34 is effectively connected across the starter 20.

A rheostat 48 is connected across the leads 28, 30. The output of the rheostat 48 is directed to a resistor 50 and a diode 52 in series with each other. A line 54 is connected at one end to the diode 52 and at the other end to the gate terminal 40. A gas diode 56 and a resistor 58 are in series with each other and are placed in the line 54. A capacitor 60 is placed in the line 44 intermediate the connection with the lines 30, 54.

When the voltage across terminals 36, 38 is lower than the forward voltage breakover point of the SCR 34, the SCR 34 is not conducting and the lamp 10 is operated in conventional fashion with the starter 20 and the flasher 26 effectively being an open circuit. When the current at the gate terminal 40 reaches a sufficient value, the breakover point of the SCR 34 is exceeded and current is permitted to flow. The quantity and timing of the current applied to the gate terminal 40 therefore controls operation of the flasher 26 and, hence, flashing of the lamp 10. The diode 52 causes the capacitor 60 to be charged during half-cycle operation of the power signal and, when a sufficient voltage has been accumulated by the capacitor 60, the gas diode 56 is fired, thereby suddenly triggering the SCR 34 into a conducting mode.

Figure 4:
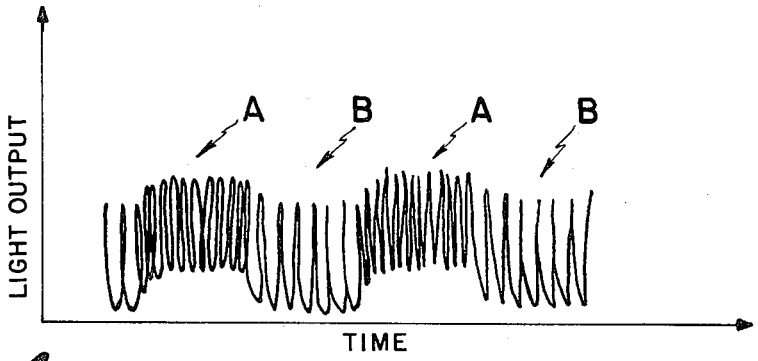
FIG. 4 is a plot of light output versus time for a fluorescent lamp flashed by circuitry in accordance with the invention.

Because the SCR 34 essentially is a half-wave rectifier, the lamp 10 is modulated between full brilliance and substantially half brilliance. That is, the lamp 10 is shorted only in one direction and a light-producing discharge occurs on the other half cycle. FIG. 4 is a plot of light output versus time for a fluorescent lamp 10 flashed by circuitry 31 in accordance with the invention. The areas of the curve marked "A" indicate full lamp brilliance, and the areas of the curve marked "B" indicate substantially half lamp brilliance due to the effect of the SCR 34.

Figure 5:
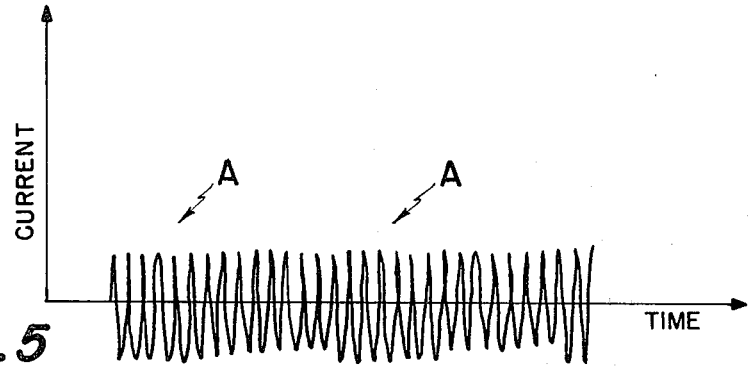
FIG. 5 is a plot of line current versus time for a fluorescent lamp flashed by circuitry in accordance with the invention.
Figure 6:
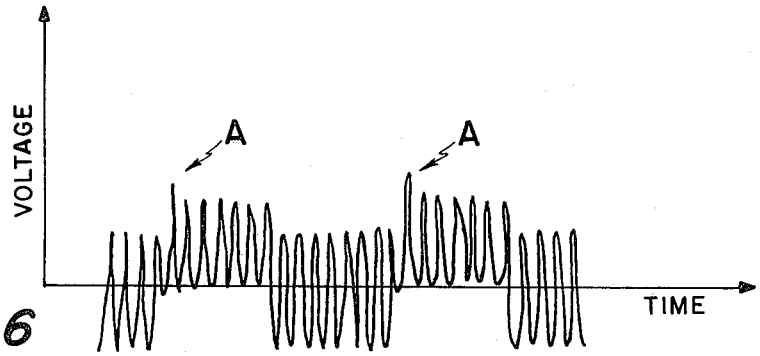
FIG. 6 is a plot of lamp voltage versus time for a fluorescent lamp flashed by circuitry in accordance with the invention.

Referring to FIGS. 5 and 6, plots of line current and lamp voltage, respectively, versus time, are plotted for a fluorescent lamp 10 flashed by circuitry 31 in accordance with the invention. Those portions of the curve of FIG. 5 marked "A" show that line current is increased only slightly when the lamp 10 is shorted. Point A on the curve of FIG. 6 indicates that on the half-cycle following current by-pass through the flasher 26, there is a larger than normal peak in lamp voltage. This peak in lamp voltage at first was thought to be a potentially damaging factor to the electrodes 12, 14, but tests have demonstrated that electrode life has not suffered using flasher circuitry 31 according to the invention.

A preferred flashing rate is about two or three flashes per second. The flashing circuitry 31 is adjustable for flash rates of approximately one-half per second to approximately five per second. The circuitry 31 is normally not conducting. When the circuitry 31 is conducting, it does so for approximately eight cycles. In order to achieve the results, the following component values may be employed: SCR 34—General Electric type 103; rheostat 48—one megohm; resistor 50—27.6 kilohms; diode 52—rectifier diode type 1N4004; gas diode 56—General Electric type NE23; resistor 58—180 kilohms; capacitor 60—0.47 microfarads.

Figure 7:
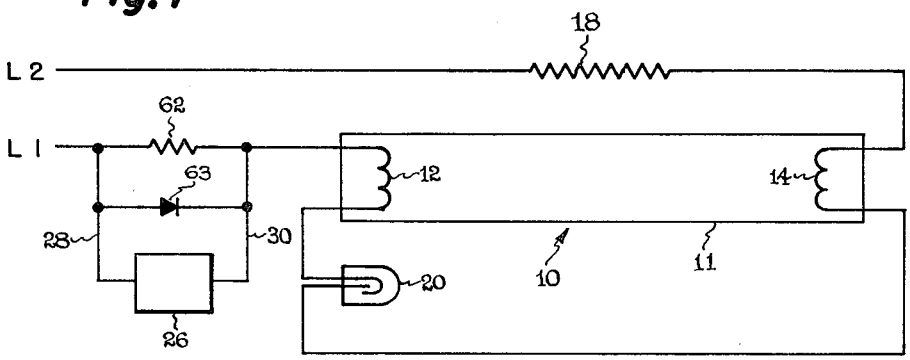
FIG. 7 is a schematic diagram of a fluorescent lamp and another embodiment of flasher circuitry in accordance with the invention, the flasher circuitry being placed in a line cord supplying current to the lamp; and, FIG. 8 is a schematic diagram similar to that of FIG. 7 in which a full wave diode bridge is employed.
Figure 8:
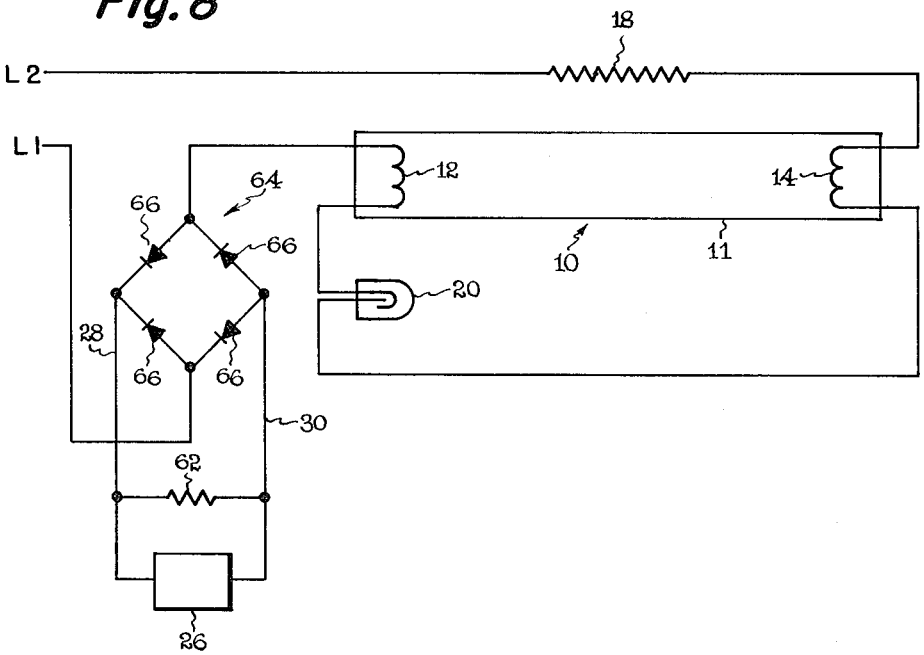

Referring to FIGS. 7 and 8, another embodiment of the invention is shown. The components of the invention are substantially the same as those shown earlier, except that the flasher 26 is placed "upstream" of the lamp 10 in the line L1. Flasher circuitry 31 identical to that illustrated in FIG. 3 is used, with the exception that in FIG. 7 a resistor 62 and a diode 63 are placed in parallel with the circuitry 31. The resistor 62 has a resistance of approximately 3000–4000 ohms. The diode 63 is a rectifier diode type 1N5060.

When the embodiment of FIG. 7 is operated with the SCR 34 non-conducting, the diode 63 permits current to flow continuously for the negative half-cycle of the power signal, thereby providing full power to the lamp 10. During the positive half-cycles of the power signal, the resistor 62 permits approximately 10 to 20 milliamps to flow through the lamp 10 to prevent loss of charge carriers and subsequent delay on restart. Depending on the resistance of the resistor 62, the modulation of light output (ratio of half-wave output to full wave output) can be about 40 percent and an effective flashing action will occur. When the SCR 34 is conducting, operation of the diode 63 is unaffected; however, the positive half-cycles of the power signal are transmitted undiminished. Accordingly, the embodiment of FIG. 7 operates reversely compared with the first-described embodiment in that the flasher circuitry 31 causes the output of the lamp 10 to be increased to full capacity when the SCR 34 is conducting and the output of the lamp 10 is decreased when the SCR 34 is non-conducting. As is well known in the art, the component values of the flasher circuitry 31 can be selected such that the SCR 34 will be in a conducting mode for most of the time, and a flashing effect will be created by rendering the SCR 34 non-conductive for brief periods of time.

In FIG. 8, a diode bridge 64 consisting of diodes 66 is placed in the line L1 and across the leads 28, 30 to replace the diode 63. Each of the diodes 66 is a rectifier diode type 1N5060. The full wave bridge 64 operates similarly to the diode 63. However, during both positive and negative half-cycles with the SCR 34 non-conducting, the resistor 62 permits enough current to flow through the lamp 10 to prevent deionization. When the SCR 34 is conducting, both positive and negative half-cycles are transmitted undiminished. Therefore, the lamp 10 is modulated between entirely full power operation and entirely part power operation. Use of the bridge 64 yields a particularly effective flashing action, although the expense of the assembly is higher than with the earlier-described embodiments.

It will be appreciated that flasher circuitry according to the invention is exceedingly straightforward and relatively inexpensive. All of the flasher components can be fitted within a conventional starter housing or a housing aproximately the size of a conventional starter housing and substituted in its entirety for existing installed starters. Alternatively, the invention can be employed with equal facility by placement in a line cord supplying current to a fluorescent lamp. In this event, presently known lamp manufacturing techniques do not have to be modified to produce a fluorescent lamp having a flashing capability. An important advantage of the invention, in addition to its compactness and inexpensiveness, is that its life is compatible with that of conventional fluorescent lamps.

Although the invention has been disclosed with a certain degree of particularity, it will be understood that the present disclosure of the preferred embodiment has been made only by way of example and that various changes may be resorted to without departing from the true spirit and scope of the invention. It is intended that the patent shall cover, by suitable expression in the appended claims, whatever features of patentable novelty exist in the invention disclosed.

We claim:

1. A flasher apparatus for use with a fluorescent lamp having electrode terminals at each end, comprising:

(a) a switch means connected in one lead of the line cord supplying current to the lamp, the switch means being periodically operable in a first, current-conducting mode where current is permitted to flow in only one direction through the lead and a second, non-current-conducting mode;

(b) a control means for operating the switch means, the control means periodically switching the switch means between the first and second modes;

(c) a rectifier connected in parallel with the switch means, the rectifier permitting current to flow through the lead in a direction opposite to that direction in which current is permitted to flow by the switch means; and (d) a resistor connected in parallel with the switch means, the resistor permitting sufficient current flow during those times that the switch means is in the second mode that the lamp is flashed and deionization of the lamp is prevented, the resistor being bypassed when the switch means is in the first mode so that the lamp operates at full power.

2. The flasher apparatus of claim 1 wherein the resistor has a value of approximately 3000–4000 ohms.

3. The flasher apparatus of claim 1, wherein:

(a) the switch means is in the form of a silicon controlled rectifier having a gate terminal for controlling current flow through the silicon controlled rectifier; and (b) the control means includes a pulse firing means connected to the gate terminal for periodically directing current to the gate terminal of a magnitude sufficient to trigger current flow through the silicon controlled rectifier.

4. The flasher apparatus of claim 3, wherein the pulse firing means is a gas diode.

5. The flasher apparatus of claim 3, wherein the pulse firing means is controlled by a series-connected rectifier and a parallel-connected capacitor, the rectifier serving to charge the capacitor and the capacitor serving to fire the pulse firing means when a predetermined voltage has been attained.

6. The flasher apparatus of claim 5, wherein the pulse firing means is activated up to approximately 5 times per second and the silicon controlled rectifier is in the second mode for approximately eight consecutive cycles.

7. The flasher apparatus of claim 5, wherein a rheostat is in series with the last-named rectifier, the rheostat permitting the current flowing to the rectifier to be adjusted to produce different capacitor-charging rates and, hence, different pulse firing means discharge rates.

8. The flasher apparatus of claim 1, wherein the rectifier is a diode.

9. The flasher apparatus of claim 1, wherein the rectifier is a full wave diode bridge.

10. A flasher apparatus for use with a fluorescent lamp having electrode terminals at each end, comprising:

(a) a switch means connected in one lead of the line cord supplying current to the lamp, the switch means being periodically operable in a first, current-conducting mode where current is permitted to flow in only one direction through the switch means and a second, non-current-conducting mode;

(b) a control means for operating the switch means, the control means periodically switching the switch means between the first and second modes;

(c) a full wave rectifier connected in parallel with the switch means; and (d) a resistor connected in parallel with the switch means, the resistor permitting sufficient current flow during those times that the switch means is in the second mode that the lamp is flashed and deionization of the lamp is prevented, the resistor being bypassed when the switch means is in the first mode so that the lamp operates at full power.

11. The flasher apparatus of claim 10, wherein the resistor has a value of approximately 3000–4000 ohms.

12. The flasher apparatus of claim 10, wherein:

(a) the switch means is in the form of a silicon controlled rectifier having a gate terminal for controlling current flow through the silicon controlled rectifier; and (b) the control means includes a pulse firing means connected to the gate terminal for periodically directing current to the gate terminal of a magnitude sufficient to trigger current flow through the silicon controlled rectifier.

13. The flasher apparatus of claim 12, wherein the pulse firing means is a gas diode.

14. The flasher apparatus of claim 12, wherein the pulse firing means is controlled by a series-connected rectifier and a parallel-connected capacitor, the rectifier serving to charge the capacitor and the capacitor serving to fire the pulse firing means when a predetermined voltage has been attained.

15. The flasher apparatus of claim 14, wherein the pulse firing means is activated up to approximately 5 times per second and the silicon controlled rectifier is in the second mode for aproximately eight consecutive cycles.

16. The flasher apparatus of claim 14, wherein a rheostat is in series with the last-named rectifier, the rheostat permitting the current flowing to the rectifier to be adjusted to produce different capacitor-charging rates and, hence, different pulse firing means discharge rates.

17. The flasher apparatus of claim 10, wherein the full wave rectifier is a diode bridge.

* * * * *